US006074093A

United States Patent [19]

Anderson

[11] Patent Number: 6,074,093

[45] Date of Patent: Jun. 13, 2000

[54] THERMAL INSULATING CONTAINER

[76] Inventor: Brian Anderson, 1 Curragh Court, Portland, Victoria 3305, Australia

[21] Appl. No.: 09/176,823

[22] Filed: Oct. 22, 1998

[30] Foreign Application Priority Data

Oct. 23, 1997 [AU] Australia ..... P09953

[51] Int. Cl.[7] ..... B65D 30/20

[52] U.S. Cl. ..... 383/4; 383/110

[58] Field of Search ..... 383/4, 110

[56] References Cited

U.S. PATENT DOCUMENTS

| | | | |
|---|---|---|---|
| 4,679,242 | 7/1987 | Brockhaus | 383/4 |
| 4,802,233 | 1/1989 | Skamser | 383/110 |
| 4,881,684 | 11/1989 | Chinman | 383/4 |
| 5,551,108 | 9/1996 | Butler, III | 383/4 |
| 5,800,061 | 9/1998 | Volles | 383/110 |
| 5,857,778 | 1/1999 | Ells | 383/110 |
| 5,904,230 | 5/1999 | Peterson | 383/4 |

*Primary Examiner*—Stephen P. Garbe
*Attorney, Agent, or Firm*—Dilworth & Barrese

[57] ABSTRACT

A container having an internal space for thermally insulating one or more articles to be temporarily stored in the internal space. The container includes a number of space defining members, in the form of panels and flaps, that are held in a space defining relationship by releasable fastening means, such as hook and loop fabric material, whereby the container can be transformed from a closed configuration defining the internal space to an open configuration substantially exposing all of the space defining members providing access to cleaning of the members.

23 Claims, 5 Drawing Sheets

THERMAL INSULATING CONTAINER

BACKGROUND OF THE INVENTION

1. Field of the Invention

This invention relates to a container for thermally insulating one or more articles to be temporarily stored or transported from one location to another, and more particularly to a container for thermally insulating one or more articles and constructed in a manner that allows easy access to the interior thereof for cleaning purposes.

2. Description of Related Art

Presently there exist containers for temporarily storing or transporting articles, such as food, that keeps the article hot or cool whilst it is being stored or transported from one place to another. These containers are typically in the form of bags or pouches having an exterior surface within which is defined an interior space where articles or contents, such as food items, are stored. Access to the interior space is via a fold down flap, the flap extending from and hingedly connected to a bottom panel of the bag. The bag is closed to secure the contents by folding the flap over the opening and tucking the flap either upon itself into the opening or under a strap on the top panel of the bag. A typical use for such bags is in the delivery of pizzas from a pizza shop to a customer's home or business address. The pizza is placed into a cardboard box, then closed, and then inserted into the above-described bag or pouch, after which the flap is folded, and then delivery is undertaken.

These types of containers are usually stitched where two panels of the container meet and define a boundary of the panels, the stitching being implemented to seal insulating material between various corresponding panels of the exterior and interior surfaces of the container.

A problem with such stitched containers is that the interior space is difficult to access for the purposes of cleaning the interior surfaces of the container. It is a fundamental requirement to be able to clean the interior surfaces for the purposes of hygiene and reducing or eliminating contamination of food products that are placed in these containers. The interior space is limited in volume and is only able to be accessed via the opening. This makes it difficult to place a hand or a cleaning implement inside the interior space as the container cannot be fully opened. Furthermore, there is the added problem of a user seeing where to clean due to the relatively dark or dull interior of the container.

The present invention provides a container whereby its interior surfaces are easily accessed to enable a user to satisfactorily clean these surfaces.

SUMMARY OF THE INVENTION

Accordingly, the present invention provides a container having an internal space and adapted for thermally insulating one or more articles to be temporarily stored in said internal space, said container comprising:

a plurality of space defining members characterized in that said space defining members are held in a space defining relationship by a releasable fastening means such that said container can be readily transformed from a first closed configuration defining said internal space to a second open configuration substantially exposing all of said space defining members for cleaning access.

The space defining members may include a bottom panel, a top panel, two side wall panels and, a rear panel; said bottom panel, top panel, two side wall panels and rear panel being fastened by said releasable fastening means which may be in the form of hook fabric material and loop fabric material to define said internal space, wherein one or more of said articles are adapted to be placed in said internal space. A front flap may close an opening to said interior space such that said container thermally insulates said articles located in said internal space.

Each side wall panel may be attached to said bottom panel at opposite edges of said bottom panel and said rear panel may have a portion thereof attached to an edge of said bottom panel intermediate said opposite edges. The top panel may have a portion thereof attached to an edge of said rear panel opposite said attachment of the rear panel to the bottom panel. Each of the side wall panels may have an exterior surface having a strip of hook fabric material, The rear panel may have a side flap attached thereto at opposite edges of the rear panel, not being the edges to which is attached the top panel or the bottom panel. Each of side flaps of said rear panel having an interior surface and an exterior surface. There may be attached to each of the interior surfaces of said rear panel side flaps a strip of loop fabric material and there may be a strip of hook fabric material attached to each of the exterior surfaces of said rear panel side flaps. The top panel may have side flaps each having an interior surface and an exterior surface. Attached to each interior surface of the top panel side flaps there may be a strip of loop fabric material.

The interior space of the container may be formed in such a manner that the strips of hook fabric material of each side wall panel engage with respective strips of loop fabric material on the interior surfaces of the rear panel side flaps and the strips of loop fabric material of each top panel side flaps engage respectively with the hook fabric material of the rear panel side flaps and the hook fabric material of the side wall panels.

The opening to the container may be formed adjacent each side wall panel and opposite said rear panel. The front flap may have a portion thereof that covers said opening such that said portion has a surface area substantially the same as the cross sectional area of said opening. On an interior surface of the front flap there may be a strip of loop material that engages with a corresponding strip of hook fabric material located on an exterior surface of said top panel to effectively close said front flap and keep the one or more articles thermally insulated.

BRIEF DESCRIPTION OF THE DRAWINGS

A preferred embodiment of the invention will now be described with reference to the accompanying drawings wherein.

DETAILED DESCRIPTION OF THE INVENTION

Figure 1:
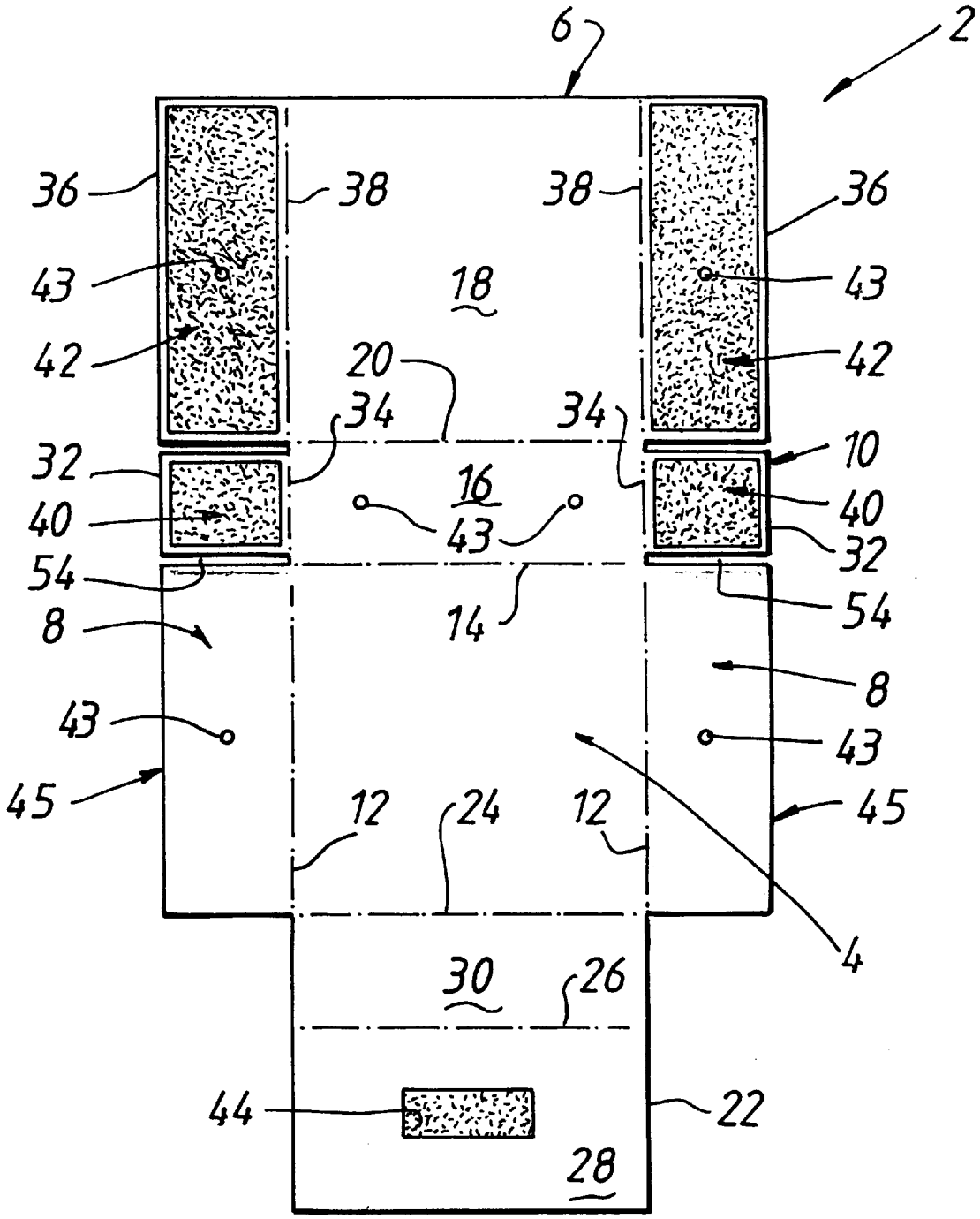
FIG. 1 is a plan view of a container according to the present invention in which is shown the interior surfaces of space defining members of the container in an unassembled condition.

In FIG. 1, there is shown a container 2 in a substantially flat and unassembled condition. The container 2 has a number of space defining members in the form of panels and specifically has a bottom panel 4, a top panel 6, two side wall panels 8 and a rear panel 10. The bottom panel 4 is substantially quadrilateral in shape and is preferably square or rectangular. The side wall panels 8 are attached to the bottom panel 4 at opposite edges 12 of the bottom panel 4, the edges 12 serving as fold lines about which the side wall panels 8 may be folded. The rear panel 10 has an intermediate potion 16 which is attached to edge 14 of bottom panel 4 and is foldable with respect to the bottom panel 4 about edge 14. The top panel 6 has a portion 18 that is quadrilateral in shape, and is preferably square or rectangular, and is attached to the rear panel 10 by way of edge 20 about which portion 18 is foldable with respect to the rear panel 10. Attached to a front edge 24 of the bottom panel 4 is a front flap 22, the front flap 22 has a fold line 26 about which portion 28 of front flap 22 is foldable. A portion 30 of front flap 22 is also foldable about edge 24 of bottom panel 4.

The read panel 10 has side flaps 32 extending from intermediate portion 16 with each side flap 32 being foldable with respect to the intermediate portion 16 about edges 34 of the, intermediate portion 16. Similarly, the top panel 6 has side flaps 36 which extend from an intermediate portion 18 and are foldable with respect to portion 18 along edges 38 of the portion 18.

Located on an interior surface of each side panel 32 of rear panel 10 is a strip of loop fabric material 40 which is adhered to each side panel 32. The dimensions of the strips 40 can be made to any convenient size and are preferably square or rectangular in shape to fit the corresponding internal surface area of each side flap 32. Similarly, each side flap 36 of the top panel 6 has a strip of loop fabric material 42 adhered to the interior surface thereof as shown in the figure. The dimensions of the strip 42 are conveniently chosen to cover the surface area of the internal surface of each side flap 16. Each strip of loop fabric material 42 is preferably rectangular in shape and extends along the entire length of the internal surface of each side flap 36. It is to be noted that any suitable length or size of the strips may be chosen to suit the particular needs of the user. Located on portion 28 of front flap 22 is a small strip of loop fabric material that is adhered to that portion 28. Eyelets or small apertures 43, typically made from brass, extend through one or more of the panels and flaps to provide ventilation for the articles contained in the interior space 3 of the container.

Figure 2:
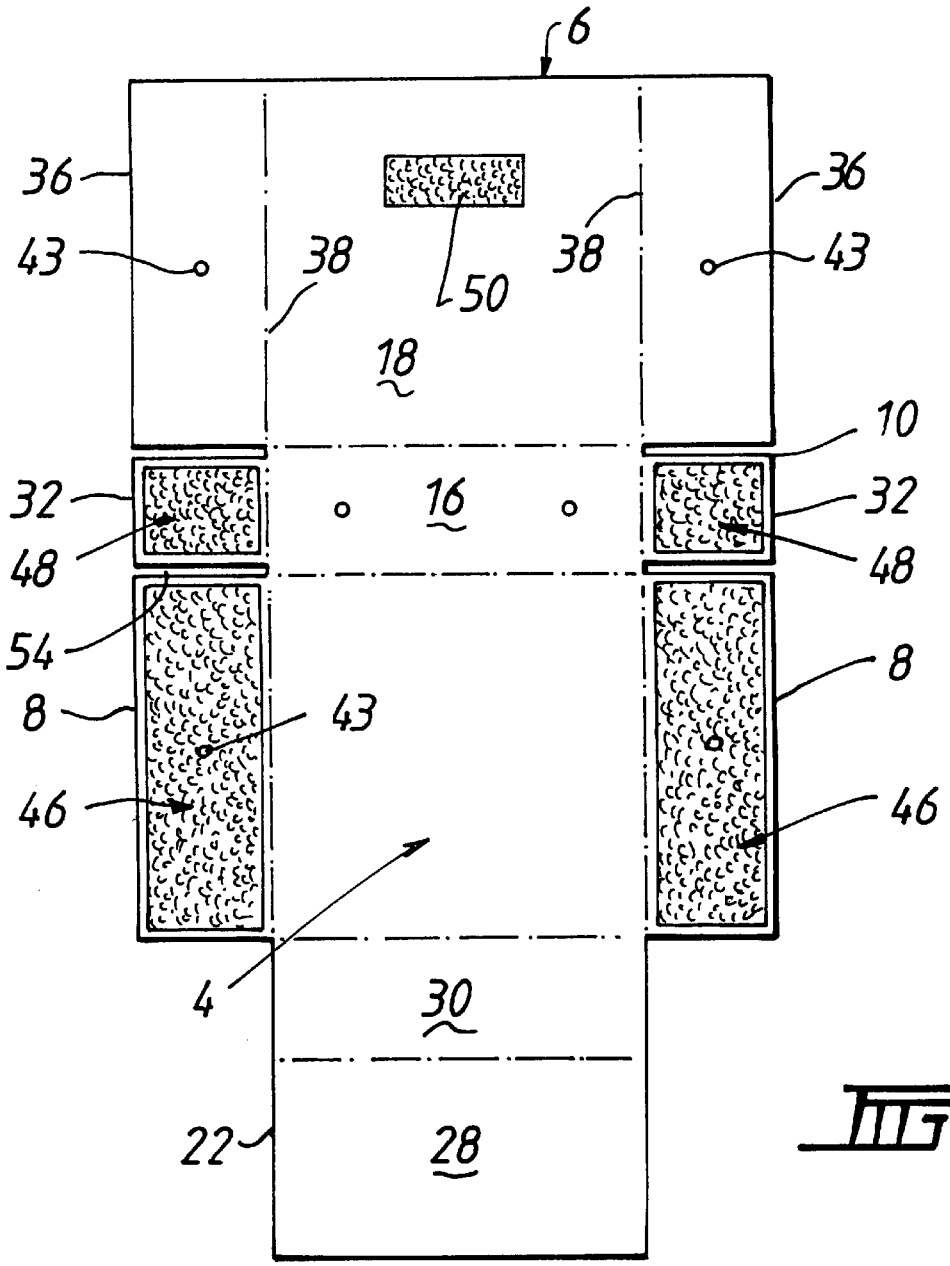
FIG. 2 is an underneath view of the container in FIG. 1 showing the exterior surfaces of the space defining members of the container.

In FIG. 2, there is shown the reverse or opposite view of the container 2 as shown in FIG. 1 wherein the exterior surfaces of each of the various panels and flaps are shown. On the exterior surface of side wall panels 8 there is adhered strips of hook fabric material 46 which extends substantially along the length of the side wall panels 8. It is to be noted that the dimensions of the strip of hook fabric material 46 can be made to Suit the particular needs of the individual user. Attached to or adhered to exterior surfaces of the side panels 32 of the rear panel 10 are strips of hook fabric material 48. Again, the dimensions of the hook fabric material strips 48 are not important and are made to be a suitable size according to the requirements of the user. Attached to the exterior surface of portion 18 of the top panel 6 is a small strip of hook fabric material 50 which can be made to be of corresponding dimensions to the strip 44 of loop fabric material located on an interior surface of portion 28 of front panel 22. The: hook fabric material and loop fabric material together constitute a releasable fastening means known as "VELCRO" (registered Trade Mark) material. Any other suitable releasable fastening means may be used for holding the space defining members of the container in a space defining relationship.

Figure 3:
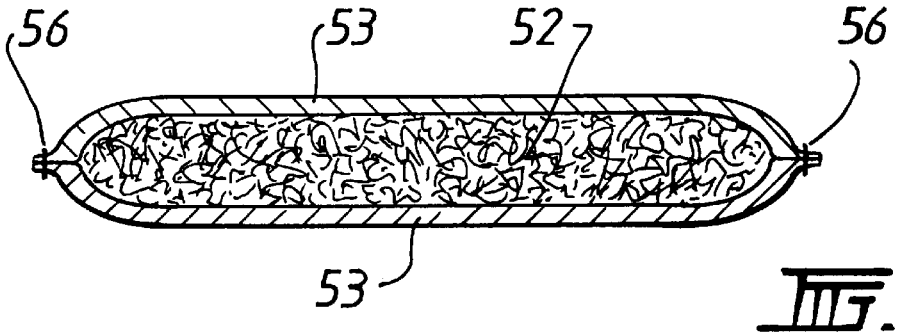
FIG. 3 is a cross sectional view of any one of the space defining members of the container.

In FIG. 3, there is shown a cross section of each of the panels used that make up the container 2. Each panel consists of a layer of insulating material, such as polystyrene foam, 52 which acts as an insulator for the articles to be placed inside the container so that they are kept within a required temperature range. The layer of polystyrene foam 52 is covered on both sides with a layer of durable material, such as vinyl, 53 which is then stitched at the peripheries 56 so that the foam layer 52 is completely encapsulated by the layers of vinyl 53. Each of the panels are suitable stitched using nylon around the perimeter and such stitching occurs at places shown where the dotted lines occur in each of FIGS. 1 and 2.

Figure 4:
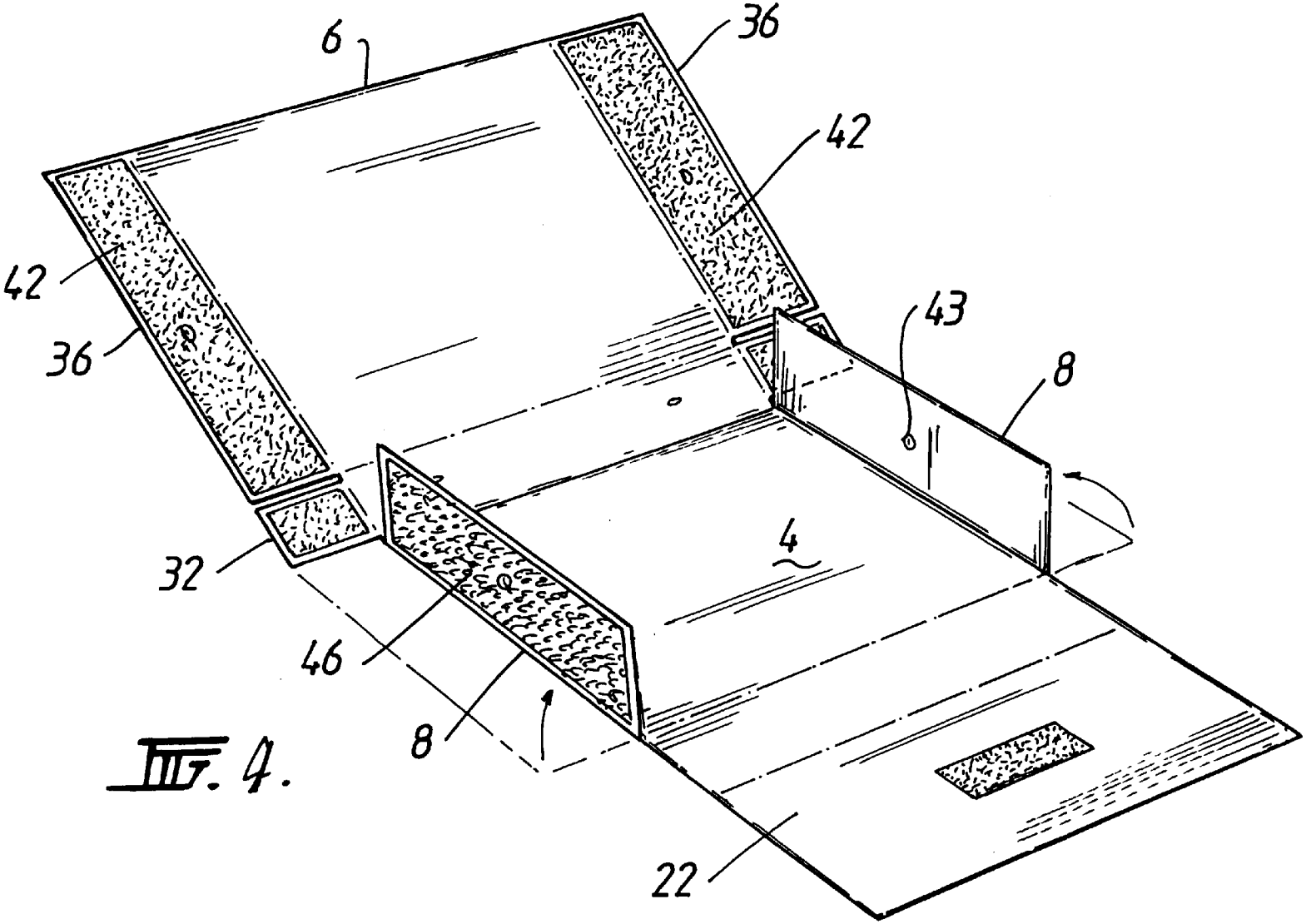
FIG. 4 is a perspective view of a container initially laid flat with side wall panels in an upward configuration with respect to a bottom panel of the container.

In FIG. 4, there is shown the initial stage of assembling the container 2 from an originally substantially flat position as shown in FIG. 1. The first step is to lift the side wall flaps 8 in an upwardly direction with respect to the bottom panel 4 such that the side wall panels are substantially perpendicular to the bottom panel 4. This exposes the strip of hook fabric material 46 on the exterior surfaces of the side wall panels 8.

Figure 5:
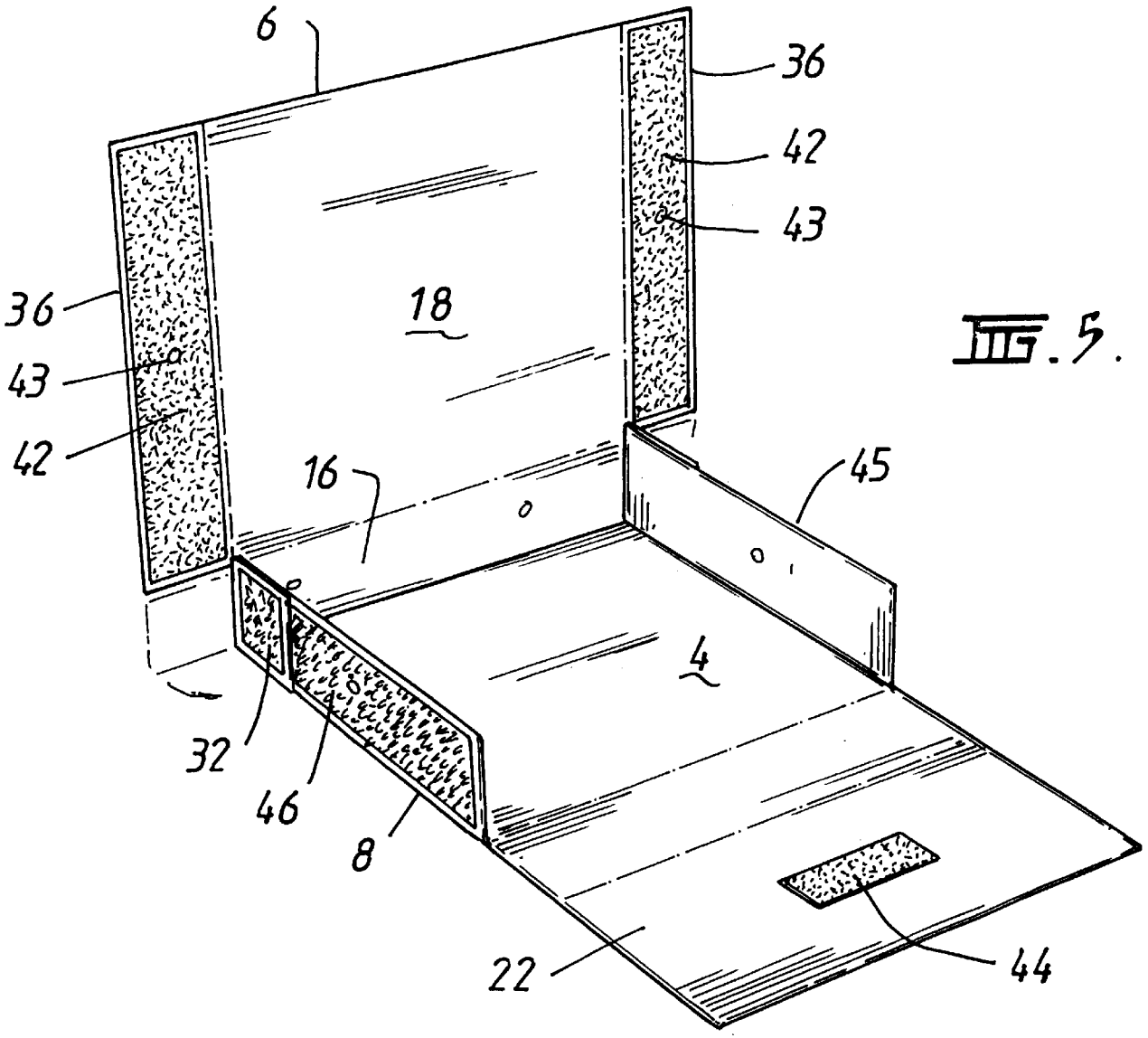
FIG. 5 is similar to FIG. 4 showing rear panel side flaps engaged with the side wall panels and a top panel upwardly directed.
Figure 6:
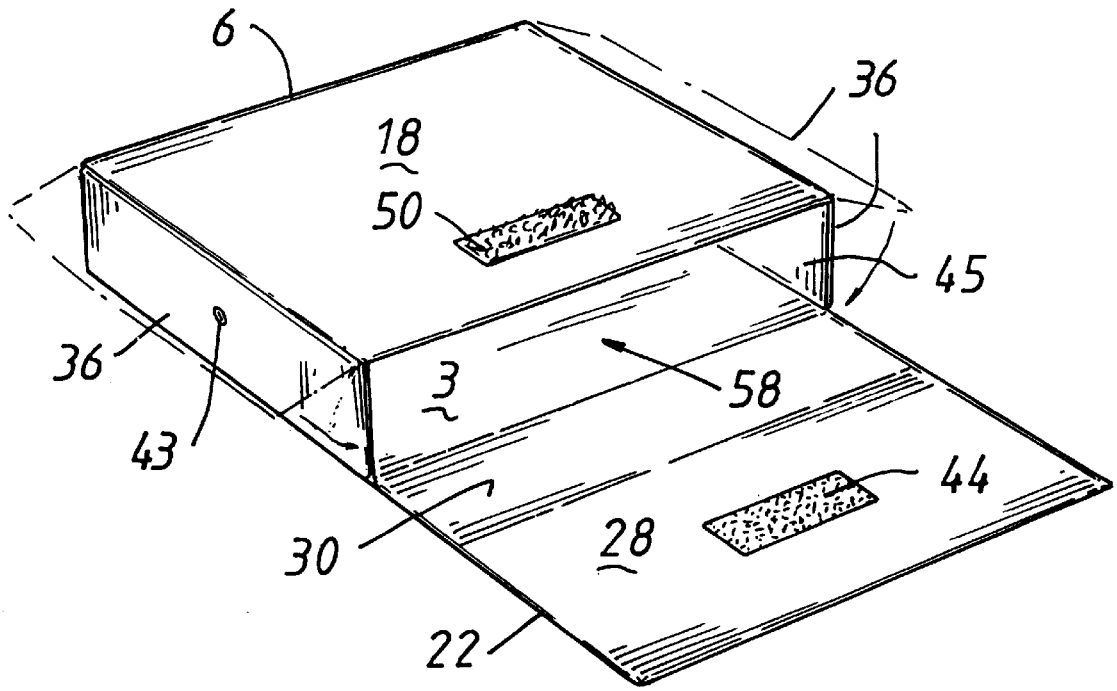
FIG. 6 is similar to FIG. 5 showing top panel side flaps engaged with the rear panel side flaps and the side wall panels of the container.
Figure 7:
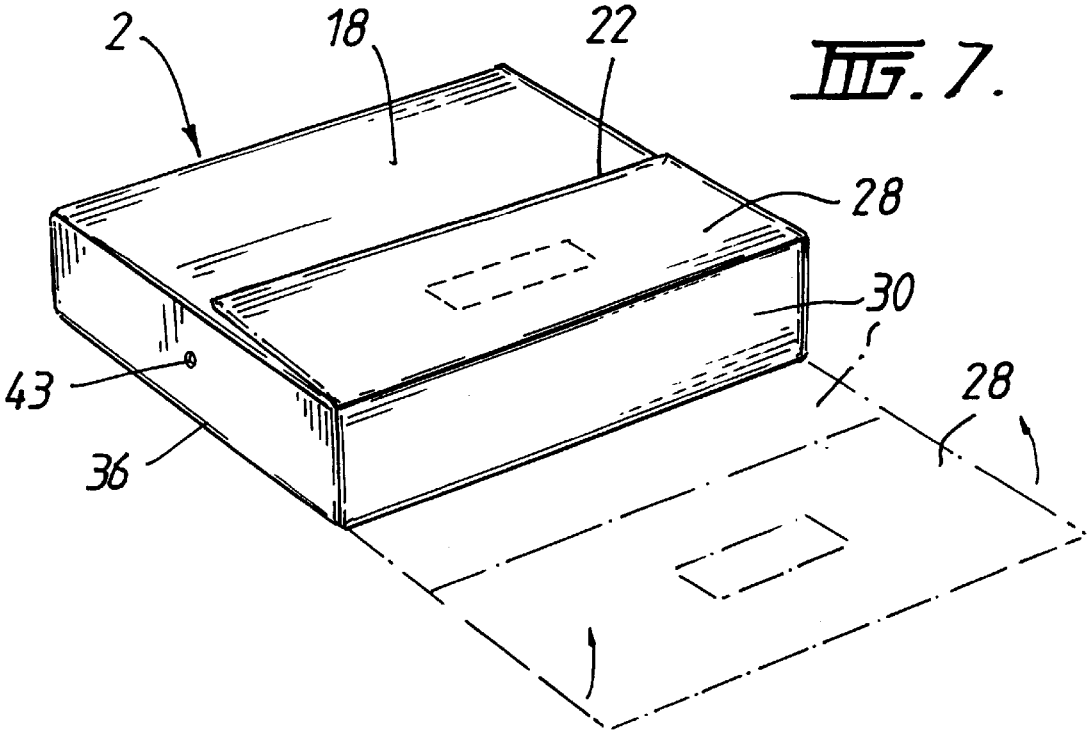
FIG. 7 is a perspective view of the container in a fully assembled form.

In FIG. 5, the next stage is shown wherein the rear panel side flaps 32 are folded about edges 34 through approximately 90° so that the flaps 32 are folded around the outside of the panels 8. This enables the loop fabric material strips 40 of the panel of the flap 32 to positively engage respectively at least a portion of the strips 46 of hook fabric material In FIG. 6, the next stage is shown wherein the top panel 6 is folded about edge 20 through approximately 90° so that it rests on the top edges 45 of the side wall panels 8 that were shown in FIG. 5. The side flaps 36 of the top panel 6 are then folded through approximately 90° about edge 38 such that the loop fabric material strips 42 of each flap 36 positively engage the hook fabric material strips 48 of side flaps 32 and the remaining portion of the hook fabric material strips 46 of the side wall panels 8 as is shown in FIG. 6. The configuration now shown in FIG. 6 provides an opening 58 to the internal space 3 created by the above steps in forming the container 2. Any article required to be maintained at a particular temperature can be now inserted into the internal space of the container 2 through opening 58. For example, a ready made pizza can be inserted into the interior space to rest on bottom panel 4 and then the front flap 22 may be moved upwardly and folded about edge 24 of bottom panel 4 such that the portion 30 of the front flap 22 substantially closes the opening 58 and then the portion 28 of front flap 22 is folded about edge 26 such that the strip 44 of loop fabric material positively engages the hook fabric material strip 50 on the top panel 6. This arrangement as shown in FIG. 7 now thermally insulates the one or more articles that have been placed into the container for delivery from one location to another. The space defining members, or panels, are held in a space defining relationship by the releasable fastening means.

The container 2 initially is in a fully opened position as shown in FIG. 1 and then assembled by folding the panels 8 upwardly so that they are nearly perpendicular to the bottom panel 4. The top panel 6 and rear panel 10 are then folded upwardly so that the edges 34 correspond or abut to edges 54 and the rear panel 10 is substantially perpendicular also to the bottom panel 4 and each of the side wall panels 8. The side flaps 32 are then folded through about 90° on the outside of the side wall panels 8 and then the top panel 6 is folded downwardly to be substantially parallel to the bottom panel 4 and substantially perpendicular to each of the rear panel 10 and side wall panels 8. The side flaps 36 of the top panel are then folded downwardly through nearly 90° to positively engage the material on the exterior surfaces of the side wall panels 8. The articles to be thermally insulated are then inserted into the container through opening 58 and the front flap 22 folded as previously described to totally enclose the articles.

It is to be noted that the strips of hook fabric material and the strips of loop fabric material mentioned throughout this embodiment may be reversed to the orientations shown in this embodiment. In other words, where there is shown strips of hook fabric material these can easily be replaced by strips of loop fabric material and vice versa.

Although this embodiment has been described with respect to the temporarily storage or transportation of articles of food, such as pizzas so as to keep such pizzas hot, it is to be stressed that the articles may be other perishables such as cold foods, biomedical products or specimens, etc. It may be envisaged that some articles need to be kept cool and therefore this container could equally be adapted to transport or store items that are to be refrigerated from one location to another location.

After use or delivery of the particular articles, the container 2 may be disassembled in the reverse fashion as previously described to end up with the configuration shown in FIG. 1. In this configuration, the surfaces of the interior of the container are much easier to access and therefore clean with suitable solvents and cleaning apparatus. In the previously known types of containers this was not possible due to the inflexibility of the containers in that they could not be fully opened so that access to each of the surfaces is very difficult. Therefore, there existed the possible risk of contamination of food items due to bacteria being on the various surfaces. Therefore the container described in this embodiment provides easier access to all of the internal surfaces to be cleaned thoroughly and ready for use for another delivery for one or more articles.

It will be appreciated that further modifications and alterations may be made to the embodiment described above without departing from the scope or spirit of the present invention.

What is claimed is:

1. A container having an internal space and structured and arranged for thermally insulating one or more articles to be temporarily stored in said internal space, said container comprising:

space defining members having a bottom panel, a top panel, a rear panel and a pair of side wall panels on opposite sides of said bottom panel;

a front flap connected to and foldable with respect to said bottom panel, said front flap structured and arranged, when said container is in assembled condition, to cover an opening to said internal space and contact only said top panel, such that the container is in a closed configuration;

wherein said space defining members are held in a space defining relationship by a releasable fastening means such that said container is readily transformable from said closed configuration defining said internal space to an open configuration substantially exposing all of said space defining members for cleaning access.

2. A container according to claim 1 wherein said pair of side wall panels are attached to and foldable with respect to said bottom panel.

3. A container according to claim 1 wherein said rear panel is connected to and foldable with respect to said bottom panel.

4. A container according to claim 3, wherein said rear panel has a pair of side flaps, each side flap in said pair being foldable with respect to an intermediate portion of said rear panel.

5. A container according to claim 4 wherein said pair of each flap of side flaps of each flap of said rear panel is releasably detachable to respective ones of said pair of side wall panels through said releasable fastening means.

6. A container according to claim 4, wherein said top panel has a pair of side flaps, each side flap of said top panel being foldable with respect to an intermediate portion of said top panel, and said container consists of said bottom panel, top panel with said pair of side flaps, rear panel with said pair of side flaps, said pair of side wall panels, and said front flap.

7. A container according to claim 1 wherein said top panel is connected to and foldable with respect to said rear panel.

8. A container according to claim 7 wherein said top panel has a pair of side flaps, each side flap of said top panel being foldable with respect to an intermediate portion of said top panel.

9. A container according to claim 8 wherein said side flap of each said top panel is releasably detachable to respective ones of said side flaps of said rear panel and releasably detachable to respective ones of said side wall panels, are through said releasable fastening means.

10. A container according to claim 1 wherein said releasable fastening means is in the form of hook fabric material and loop fabric material.

11. A container according to claim 10 wherein said side wall panels have an interior surface and an exterior surface, said exterior surface of each side wall panel having adhered thereto a strip of hook fabric material.

12. A container according to claim 11 wherein each said side flap of said rear panel has an interior surface to which is adhered a strip of loop fabric material and an exterior surface to which is adhered a strip of hook fabric material.

13. A container according to claim 12 wherein said strip of hook fabric material on said exterior surface of said side wall panels are respectively adapted for positive engagement with said strip of loop fabric material on said interior surface of said side flaps of said rear panel.

14. A container according to claim 13, wherein said side flaps of said top panel have an interior surface and an exterior surface, each said interior surface of said side flaps of said top panel having adhered thereto a strip of loop fabric material structured and arranged for positive engagement with respective strips of hook fabric material on said exterior surface of said respective side flaps of said rear panel and structured and arranged for positive engagement with said hook fabric material on said exterior surface of said respective side wall panels.

15. A container according to claim 14 wherein said front flap has an interior surface having a strip of loop fabric material structured and arranged for positive engagement with a strip of hook fabric material adhered to an exterior surface of said top panel.

16. A container according to claim 1 wherein one or more of said space defining members has one or more eyelets to provide for ventilation of articles contained in said interior space in said closed configuration of said container.

17. A container according to claim 1 wherein to attain said open configuration of said container each of said space defining members held in said space defining relationship are detachable from one another by releasing said fastening means.

18. A container according to claim 1 wherein said space defining member are constituted by a layer of insulating material covered by a layer of durable material.

19. A container according to claim 18, wherein the durable material is vinyl.

20. A container having an internal space and structured and arranged for thermally insulating one or more articles temporarily stored in said internal space, said container comprising:

space defining members constituted by a bottom panel, a top panel, a rear panel connecting said top and bottom panels, a pair of side wall panels provided on opposite sides of said bottom panel, a front flap connected to and foldable with respect to said bottom panel, said front flap structured and arranged, when said container is in assembled condition, to cover an opening in said internal space, such that the container is in a closed configuration, said rear panel has a pair of side flaps, each side flap in said pair being foldable with respect to an intermediate portion of said rear panel, said top panel has a pair of side flaps, each side flap of said top panel being foldable with respect to an intermediate portion of said top panel, said top, bottom and rear panels and respective side wall panels and side flaps being structured and arranged such that, in assembled condition, interior surfaces of said side flaps of said rear panel contact respective exterior surfaces of respective side wall panels affixed to said bottom panel and interior surfaces of respective side flaps of said top panel contact respective exterior surfaces of both said side flaps of said rear panel and said side flaps of said bottom panel.

21. A container according to claim 20, wherein said top flap is structured and arranged to contact only an exterior surface of said top panel when in closed condition.

22. A container according to claim 20, wherein said exterior surfaces of side walls affixed to said bottom panel are respectively provided with hook or loop fasteners, said interior and exterior surfaces of said side flaps affixed to said rear panel are both provided with hook or loop fasteners, and said interior surfaces of side flaps appended to said top panel are provided with hook or loop fasteners.

23. A container according to claim 22, wherein the exterior surfaces of the side walls appended to the bottom panel are provided with strips of hook fabric material, the interior and exterior surfaces of the side flaps appended to the rear panel are respectively provided with strips of loop fabric material and hook fabric material, and the interior surfaces of the side flaps appended to the top panel are provided with strips of loop fabric material.

* * * * *